166-250 SR
FIP8011 XR 4,090,398

United States Patent [19]
Deans et al.
[11] 4,090,398
[45] May 23, 1978

[54] METHOD FOR DETERMINING FLUID SATURATIONS IN RESERVOIRS

[75] Inventors: Harry A. Deans; James R. Bragg, both of Houston, Tex.

[73] Assignee: Exxon Production Research Company, Houston, Tex.

[21] Appl. No.: 756,150

[22] Filed: Jan. 3, 1977

Related U.S. Application Data

[63] Continuation-in-part of Ser. No. 647,223, Jan. 7, 1976, abandoned.

[51] Int. Cl.[2] ..... E21B 43/22
[52] U.S. Cl. ..... 73/19; 166/250
[58] Field of Search ..... 73/19, 23, 61 R; 23/230 EP; 166/250, 252

[56] References Cited

U.S. PATENT DOCUMENTS

| | | | |
|---|---|---|---|
| 3,590,923 | 7/1971 | Cooke | 166/252 |
| 3,685,345 | 8/1972 | Wise | 73/19 |
| 3,690,167 | 9/1972 | Chase et al. | 23/230 EP |
| 3,847,548 | 11/1974 | Keller et al. | 166/252 |
| 3,856,468 | 12/1974 | Keller et al. | 166/252 |

*Primary Examiner*—Richard C. Queisser
*Assistant Examiner*—Stephen A. Kreitman
*Attorney, Agent, or Firm*—Gary D. Lawson; Michael A. Nametz

[57] ABSTRACT

A method for determining the relative amounts of two fluid phases in a subterranean formation containing one mobile phase and a substantially immobile phase. A fluid which is substantially free of the immobile phase is injected into the formation by means of a well in an amount such that a portion of the injected fluid in the formation remains unsaturated with the immobile phase. The injected fluid is then preferably produced from the formation by means of the injection well. In another embodiment, the injected fluid is produced from the formation by means of a second well. The concentration of immobile fluid dissolved in the produced fluid is measured to determine the relative amounts of the two fluid phases in the formation.

17 Claims, 1 Drawing Figure

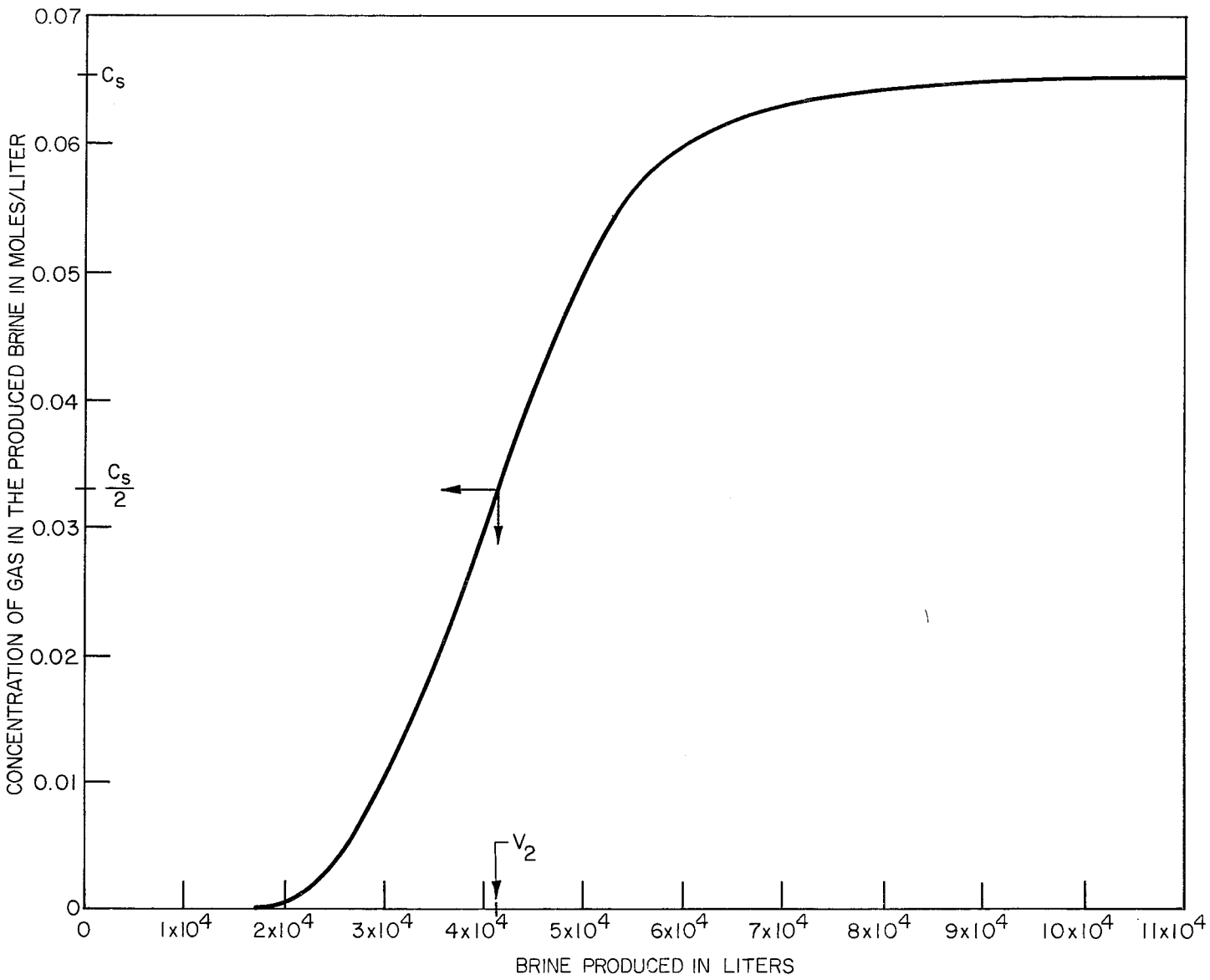
CONCENTRATION OF GAS IN THE PRODUCED BRINE IN MOLES/LITER
0.07
0.06
0.05
0.04
0.03
0.02
0.01
0
$C_s$
$\frac{C_s}{2}$
0
1x10^4
2x10^4
3x10^4
4x10^4
5x10^4
6x10^4
7x10^4
8x10^4
9x10^4
10x10^4
11x10^4
$V_2$
BRINE PRODUCED IN LITERS

METHOD FOR DETERMINING FLUID SATURATIONS IN RESERVOIRS

CROSS-REFERENCE TO RELATED APPLICATION

This application is a Continuation-In-Part of U.S. Pat. application Ser. No. 647,223, filed Jan. 7, 1976, now abandoned.

BACKGROUND OF THE INVENTION

1. Field of the Invention

This invention relates to a process utilizing a well or wells and includes the steps of testing or measuring formation fluids. More specifically, this invention relates to a method for determining the fluid saturations of an immobile fluid phase and at least one mobile fluid phase in a subterranean reservoir.

2. Description of the Prior Art

A typical oil-productive formation is a stratum of rock containing tiny interconnected pore spaces which are saturated with oil, water and gas. Knowledge of the relative amounts of these fluids in the formation is indispensable to proper and efficient production of the formation oil. When a formation is first drilled, it is necessary to know the original oil saturation to intelligently plan the future exploitation of the field. In tertiary recovery techniques, such as in solvent flooding, the quantity of oil present in the formation will often dictate the most efficient manner of conducting such an operation.

It is also desirable to know the gas saturation in a formation which is flooded by water or oil. As gas is withdrawn from a formation containing gas and at least one other mobile liquid such as formation brine or crude oil, the mobile liquid replaces the space formerly occupied by the produced gas. Laboratory and field tests have shown, however, that large quantities of gas remain trapped in the formation. This unproduced gas represents the natural gas saturation which is unable to flow because there is no longer any permeability to gas due to the gas-water saturation relationship. Once the formation is filled with brine or oil, from one-tenth to one-half of the initial gas volume is potentially lost as a residual phase. It is generally desirable, therefore, to know the residual gas saturation in the portion of the formation flooded by water to estimate the recoverable gas in the unflooded portion of the formation.

There are several methods which are currently used to obtain the fluid saturation of a formation. Coring, one technique used for acquiring this information, is a direct sampling of the formation rock and liquids. For example, a small segment of the formation rock saturated with fluids is cored from the formation and removed to the earth's surface where its fluid saturation can be analyzed. This method, however, is susceptible to the faults of the sampling technique; thus, a sample taken may or may not be representative of the formation as a whole. Also, there is a genuine possibility that the coring process itself may change the fluid saturation of the extracted core. For example, in the coring process the fluid pressure may vary from reservoir conditions and this may cause the gas saturation to change. Moreover, coring can only be employed in newly drilled wells or open hole completions. In the vast majority of wells casing is set through the gas-bearing formation when the well is initially completed. Core samples, therefore, cannot subsequently be obtained from such a well. Finally, coring by its very nature only investigates the properties of the formation rock and fluids in the immediate vicinity of the wellbore.

Another approach for obtaining reservoir fluid saturations is by logging techniques. These techniques also investigate formation rock and fluid properties for only a short distance beyond the wellbore. These techniques study the rock fluid system as an entity; it is often difficult by this approach to differentiate between the properties of the rock and its fluids.

Material balance calculations based on production history are another approach to the problem. Estimates of fluid saturation acquired by this method are subjected to even more variables than coring or logging. The technique requires a knowledge of initial fluid saturation of a formation by some other method and knowledge of the source of the recovered fluid.

More recent methods for determining fluid saturation in a subterranean formation are concerned with injection and production of trace chemicals into and out of the formation. For example, as proposed in U.S. Pat. No. 3,590,932 issued July 6, 1971 to C. E. Cooke, Jr., a carrier fluid containing at least two tracers having different partition coefficients between the immobile fluid and the aqueous fluid containing the tracers is injected into one location in the formation and produced from another. Due to the different partition coefficients of the tracers, they will be chromatographically separated as they pass through the formation, and this chromatographic separation is a function of the saturation of the immobile fluid phase. In another example, as suggested in U.S. Pat. No. 3,623,842 issued Nov. 30, 1971 to H. A. Deans, a carrier fluid containing a reactive chemical substance is injected into the formation through a well. The carrier fluid reactant solution is displaced into the formation, and the well is shut-in to permit the reactant to undergo a chemical change to produce additional tracer materials having different partition coefficients. When the well is produced, the tracers having different partition coefficients are chromatographically separated, and the degree of separation may be used to determine the residual fluid saturation in the formation. In still another example, as proposed in U.S. Pat. No. 3,856,468 issued Dec. 24, 1974 to Keller, residual gas saturation in a subterranean formation containing at least one mobile fluid phase can be determined. In this method, brine which is miscible with the formation brine and contains low concentrations of at least two chemical substances is injected into the formation through a well and displaced into the formation away from the well. One of these substances is a precursor that reacts in the formation to form two substances. One substance is a tracer material that partitions between the gas phase and brine differently than the precursor and the other substance is a substantially nonreactive tracer material. The well is shut-in for a period sufficient for the precursor to react, and the well thereafter is returned to production. The produced fluids are analyzed for the presence of the tracer materials and the gas saturation of the formation is determined by applying principles of chromatography. However, the use of trace chemicals to determine the residual gas saturation is subject to certain drawbacks. A principal problem with these methods is that the chromatographic separation of the trace chemicals due to their solubility in the gaseous phase can be so small that the measured results can be extremely difficult to analyze.

SUMMARY OF THE INVENTION

In accordance with the teachings of this invention the fluid saturations of an immobile fluid phase and at least one mobile fluid phase in a subterranean reservoir formation are determined by injecting into the formation a measured volume of fluid unsaturated with the immobile fluid and having limited solubility for the immobile liquid. The injected fluid is injected in an amount such that a portion of the injected fluid in the formation remains unsaturated with the immobile fluid phase. The injected fluid preferably contains a tracer to aid in analyzing the flow behavior of the injected fluid within the formation. As the injected fluid flows radially away from the wellbore it dissolves immobile fluid and reduces the immobile fluid saturation. Preferably the flow is reversed and the injected fluid is produced through the injection well in an amount sufficient to determine the volume of injected fluid substantially unsaturated with immobile fluid. Alternatively, fluid may be injected into one well and the injected fluid produced from a second well. By measuring the concentration of the immobile fluid dissolved in the produced fluid and by measuring the produced fluid volume, the relative proportions of the immobile and mobile fluids in the formation can be determined.

Objects and features of the invention not apparent from the above discussion will become evident upon consideration of the following description of the invention taken in connection with the accompanying drawing.

BRIEF DESCRIPTION OF THE DRAWING

The FIGURE is a graph of the concentration of dissolved gas in the produced water, moles/liter, as a function of liters of water produced.

DESCRIPTION OF THE PREFERRED EMBODIMENT

It will be apparent from this disclosure that the method of this invention has broad applicability. The method may be employed to determine the connate water saturation in an oil and gas reservoir. The method may be used to determine the residual gas saturation in a formation saturated with a liquid. The method may employ a single well with fluid injected into the formation and fluid withdrawn from the same well or the method may employ two wells with fluid injected through one well and fluid produced through an adjacent well. For purposes of clarity, however, only one of the many uses of this invention — determination of the residual gas saturation in a watered-out reservoir using one well — will be described in detail. The use of this method for other purposes will be readily apparent from this description.

In this embodiment, a subterranean reservoir containing residual natural gas and mobile water is penetrated by a well which has been drilled from the surface in a conventional manner. The well has been perforated to provide fluid communication between the interior of the well and the formation. The formation has an average thickness of 6.1 m and an average porosity of 30%. The formation temperature is 88° C and the fluid pressure in the formation is 168 kg/cm$^2$.

The portion of the formation being tested is watered-out. When the well was initially completed the formation in the immediate vicinity of the well was gas producing. However, as gas was produced from the well and other wells higher in the formation, a strong natural water drive displaced the gas from the lower portion of the reservoir. At this point in time, no measurable quantities of gas are being produced from the well and the gas in the reservoir is essentially immobile. Knowledge of the residual gas saturation in the watered-out portion of the formation is important to estimate the gas reserves in the upper portion of the formation which has not been invaded by water. This gas saturation may be determined in the following manner.

A liquid that is substantially free of dissolved gas is injected into the formation by means of the well. Brine previously produced from the subterranean formation is used as the injection liquid. The use of brine will insure miscibility and compatibility with the formation liquid. 795 m$^3$ of brine are injected into the formation at a rate of 159 m$^3$ per day. The total injection period is 120 hours.

After the gas-free liquid has been injected, the well is produced at the rate of 64 m$^3$ per day and the produced liquid analyzed for the concentration of dissolved gas. The results of these gas concentration measurements are shown in the FIGURE. Production of brine continues until brine saturated with gas at reservoir conditions is produced.

The FIGURE graphically illustrates the concentration of gas in moles/liter in the produced brine as a function of volume of produced brine measured in liters. As can be seen from the FIGURE, about $1.6 \times 10^4$ liters of brine were produced before any gas was detected. After this volume was produced the gas concentration increased until about $9 \times 10^4$ liters had been produced. Thereafter, the gas concentration in the produced brine remained constant at 0.065 moles/liter. This concentration is the saturated gas concentration of the brine at the above stated reservoir temperature and pressure.

As will be described in greater detail hereinafter, the relative fluid saturation of the formation can be determined by relating two fluid volumes. The first volume is that between the wellbore and the injected liquid front. The second volume is that between the wellbore and the point in the formation where the gas concentration changes from injected concentration to saturated concentration. Without the effects of dispersion and diffusion this concentration change is sharp and immediate. In actual practice, however, dispersion and diffusion cause this concentration change to be smeared.

The volumes of injected liquid between the injection well and each of these two fronts can be related to the saturation of gas in the formation. It is recognized, for example, that the ratio of these two volumes remains constant during the injection cycle assuming, of course, that the fluid saturations, reservoir temperature, and the fluid pressure in the reservoir remain constant.

The volume of liquid between the injection well and the injected liquid front is readily determined by measuring the volume of liquid injected into the formation. The volume of liquid between the injection well and the front which corresponds to the location where the gas concentration in the injected fluid abruptly changes from the gas concentration in the liquid as it first enters the formation to the gas concentration at saturation conditions may be determined by measuring the concentration of gas in the produced liquid. The ability to measure the volume of fluid between the wellbore and the front which corresponds to the abrupt change in gas concentration is based on the recognition that the gas concentration profile in the injected liquid at the end of the injection cycle remains substantially the same as the liquid is produced. That is, the measured gas concentration profile as shown in the FIGURE substantially corresponds to the concentration profile in the brine at the end of the injection cycle. Referring to the FIGURE, $C_s$ is the concentration of gas dissolved in the injected liquid when the injected liquid is saturated with the gas at reservoir conditions. Since the front corresponding to the change in gas concentration between initial gas concentration and saturation gas concentration, $C_s$, is not sharp and distinct, a convenient method of determining the volume of liquid, $V_2$, between the wellbore and the front is to measure the liquid produced from the formation prior to detection of liquid containing gas at one-half the concentration of gas, $C_s/2$, in the brine at saturation conditions. Referring to the FIGURE, for the example previously described, the value of $V_2$, which corresponds to a detected gas concentration of $C_s/2$, is about $4.07 \times 10^4$ liters.

The fluid saturations of the formation can be determined from the results of this method using well known material balance principles which take into account mass transfer between a liquid phase and gas phase as the liquid phase flows through a porous medium containig immobile gas. For example, applying these material balance principles to the measured gas concentration, and the injected and produced liquid volumes of the previously recited example, the residual gas saturation, $s_{gr}$, can be expressed as:

$$S_{gr} = \frac{C_s}{C_g} \cdot \frac{V_1 - V_2}{V_2} \qquad \text{Equation 1}$$

Where $S_{gr}$ = residual gas saturation, fraction of reservoir pore volume.

$C_s$ = the concentration of gas dissolved in the injected liquid when the injected liquid is saturated with the gas at reservoir conditions (moles/liter).

$C_g$ = moles of residual gas per unit volume of residual gas at reservoir temperature and pressure (moles/-liter).

$V_1$ = the total volume of liquid injected into the reservoir (liters).

$V_2$ = the volume of produced liquid which corresponds to the volume of injected liquid between the wellbore and the front where the gas concentration in the produced liquid changes from the original injected gas concentration to saturated gas concentration $C_s$ (liters).

The concentration of gas, $C_g$, in the residual gas phase at initial reservoir conditions is determined by using sample gas laws. In order to determine $C_g$ it is necessary to know the fluid pressure in the formation, the formation temperature and the composition of the gas in the formation. The compressibility factor, which may vary for each gas composition, is determined to be 0.95 for the gas in this example.

For the foregoing example the calculated value of $C_g$ is 6.14 moles/liter and the measured value of $C_s$ is 0.065 moles/liter. The value of $V_2$ is $4.07 \times 10^4$ liters and the total injected volume $V_1$ is $7.95 \times 10^5$ liters. It follows from Equation 1, therefore, that the gas saturation is 0.196 and the water saturation is 0.804.

In another embodiment of this invention, the connate water saturation of a reservoir can be determined. In this embodiment, a fluid which is substantially immiscible with formation water and which is substantially free of water is injected into the formation. The injected fluid may include liquids such as butyl alcohol, pentyl alcohol or other higher alkanols or gases such as flue gas, nitrogen or air. After the fluid is injected into the formation by means of a well in an amount such that a portion of the injected fluid in the formation remains unsaturated with water, at least a portion of the injected fluid is produced either through an adjacent well or through the same well used for injection. The water concentration in the produced liquid is measured. The connate water saturation can be determined by using material balance principles similar to the principles described above for determining gas saturation in reservoirs.

Preferably, a tracer is incorporated in the fluid injected into the formation. The principal purpose for using a tracer is to aid in determining the fluid flow characteristics such as fluid drift and dispersion of the injected fluid. Any suitable tracer can be added to the injected fluid and the return profiles considered in calculating the residual fluid saturation. The chemical tracer is preferably detected and its concentration measured when the produced fluid is analyzed for the dissolved immobile fluid concentration. The tracer concentration profile may be used for determining when the total volume of fluid injected into the formation has been produced. Thus, knowledge of when the volume of injected fluid has been produced can be determined either by knowing the total injected fluid volume or by measuring the tracer concentration profile in the produced fluid and determining the injected fluid volume using general engineering principles.

While it is essential in this invention that the formation contain a mobile fluid, it is not essential that the formation contain an immobile fluid. This phraseology is employed for convenience and clarity and it should be understood that the immobile fluid may be capable of flowing to some extent.

Although the practice of this invention has been described above for a watered out portion of a gas formation, it is not necessary to the practice of this invention for the formation to be watered-out. For example, in a formation containing producible gas, liquid may be injected by means of a well into the portion of the formation to be tested. By injecting this liquid, the gas saturation in the formation around the wellbore will approach residual gas saturation. Sufficient fluid should, therefore, be injected into the formation so that the fluid injected in accordance with the practice of this invention will contact an immobile fluid.

The injected fluid should be substantially free of dissolved immobile fluid. For obvious practical reasons the injected fluid should be capable of taking up immobile fluid from the formation, therefore, it must not be saturated with the fluid at reservoir conditions. If the injected fluid contains dissolved immobile fluid it is essential in the practice of this invention that the immobile fluid concentration be known in order to determine the amount of the immobile fluid in the produced fluid that was absorbed from the formation. Of course, to simplify analysis of the results, it is preferred that the injected liquid be substantially free of immobile fluid.

Although the injected fluid employed in the foregoing example was miscible with the formation mobile fluid, these two fluids may be immiscible with each other. Analysis of the results, however, would be more complex if these two fluids are immiscible because it may be necessary to employ reservoir modeling techniques together with principles of chromatography to satisfactorily analyze the results. Therefore, the injected fluid is preferably miscible or substantially soluble with the mobile fluid. The immobile fluid must have a limited solubility in the injected fluid in order that a saturated concentration of immobile fluid in the mobile fluid can be attained. Preferably, the injected fluid is substantially insoluble in the immobile fluid.

The trace chemicals suitable for use in one embodiment of this invention can be selected from a wide category of known and available substances. In making such a selection the purpose of the trace chemical and the particular manner in which it is to be used should, of course, be kept in mind. As previously mentioned, the tracer in this invention is used only for material balance purposes and is not an essential feature of this invention. The chemical should be soluble in the injected fluid and it should have little or no tendency to adsorb on or react with the matrix of the porous medium. It should also be essentially insoluble in the immobile fluid. It should, of course, be capable of detection by such means as chemical analysis or radiological techniques where a radioactive chemical is employed. Although it is not a requisite, the chemical can be capable of reacting while in the formation to produce another trace chemical. Preferably, the trace chemical should be inexpensive and readily available.

The concentration of the trace chemical in the injected fluid can be established by one of ordinary skill in the art using general engineering principles. Preferably, as a matter of economics, the concentration of the trace chemical in the injected fluid ranged from about one-half to two percent by volume.

The injection and production rates of the fluids can be established by those skilled in the art by taking into account such factors as the reservoir conditions and injection and production facilities. The injection rate, however, should be sufficiently high so that the injected fluid can move through the formation against fluid drift. On the other hand, the injection rate should not be so high that the formation will fracture. In the practice of this invention the injection rate is not a significant factor in the analysis of the results because the rate of immobile fluid adsorption by the injected fluid is relatively independent of the injected fluid flow rate. The production rate should not significantly change the formation fluid pressure. Therefore, the reduction of pressure during the producing cycle should not significantly affect the results of this invention. For example, referring to the above example for determining the gas saturation in a formation, as brine is removed from the reservoir it serves to reduce the pressure on the reservoir and cause a slight expansion of the residual gas. Once the residual gas expands, the gas saturation increases and some gas comes out of solution and tends to flow to the upper portion of the reservoir. These pressure effects, therefore, may cause the gas concentration profile in the produced liquid to differ slightly from the gas concentration profile in the liquid at the end of injection. However, these pressure effects can be taken into account in analyzing the results of this invention.

The volume of injected fluid should be large enough to dissolve the immobile fluid in the formation adjacent the injection well. This is desirable in order to assure that at least a portion of the injected fluid in the formation remains unsaturated with immobile fluid and that the first produced fluid is not saturated with immobile fluid. If this first produced fluid was saturated with immobile fluid, the relative amounts of the two fluid phase in the formation could not be determined by the practice of this invention.

Various methods can be used to analyze the immobile fluid concentration in the produced fluid. For example, this determination can be made at the wellhead by determining the quantity of immobile fluid and mobile fluid being produced. If the immobile fluid is gas, care should be taken to prevent fluctuation of the gas and liquid flow rates at the wellhead because such fluctuation may complicate analysis of the gas concentration in the produced liquid. A preferred method of determining the concentration of gas in the produced liquid is to measure the gas concentration in the liquid sampled in the wellbore adjacent to the formation. A downhole sampler of conventional design can be lowered periodically from the earth's surface into the wellbore to obtain samples for this analysis. Any conventional downhole sampler which eliminates pollution, loss, or alteration of the sample can be used. An example of a suitable downhole sampler is sold under the tradename Flopetrol bottom-hole sampler, type 04-05DB by Flopetrol of Vaux-le-Penil, France. The concentration of gas and tracer in the produced carrier liquid can be analyzed in any conventional manner. For example, a subsurface sample obtained at reservoir pressure and temperature can be expanded into an apparatus such that the fluids are at atmospheric pressure and the relative amounts of gas and liquid measured at standard temperature and pressure. The concentration of trace chemicals may be detected in any conventional manner such as chromatographic techniques. Also, it is contemplated that the tracers may be radioactive isotopes and that their arrival times may be determined with radiological means.

As discussed above, this invention may be used to measure the residual natural gas concentration in a watered-out reservoir. Natural gas is a mixture of hydrocarbon gases with varying amounts of impurities. Hydrocarbon gases found in produced natural gas generally comprise methane, ethane, propane, butane, pentane, and to a lesser degree hexane, heptane, and octane. Since each of these gases may have a different solubility, the injected fluid will dissolve each of these gases to a different extent. In most instances this does not present a serious problem since most of the natural gas is composed of methane. However, where a formation contains a mixture of gases in which chromatographic effects are significant, those such chromatographic effects should be taken into account in analyzing the results of this invention.

In the practice of another embodiment of this invention, referring to Equation 1, the concentration $C_s$ of immobile fluid dissolved in mobile fluid saturated with immobile fluid at reservoir conditions is measured in any convenient manner. A fluid having substantially the same physical and chemical characteristics as the mobile fluid is then injected into the formation in an amount such that a portion of the injected fluid within the formation remains unsaturated with immobile fluid. Injected fluid is then produced by means of the well in an amount sufficient to determine the volume of injected fluid unsaturated with the immobile fluid. This volume of injected fluid which in unsaturated with immobile fluid can be determined before production of fluids which are saturated with immobile fluid. For example, production of fluids can be discontinued when injected fluids having an immobile fluid concentration of one-half the concentration of the immobile fluid concentration at saturation conditions are produced. The concentration of immobile dissolved in the produced fluid is measured as a function of the produced fluid volume to determine the relative amounts of the mobile and immobile fluids in the formation.

The technique of this invention has been illustrated by a method where a single well is used for injection and production. However, it should be obvious that a single well is not necessary. The injected liquid which is substantially free of the immobile fluid can be injected through one well and withdrawn from another. If the injected fluid is produced from a second well, a sufficient amount of the injected fluid must be injected into the formation such that a portion of the injected fluid that is produced from the second well is unsaturated with immobile fluid. The concentration of the immobile fluid dissolved in the injected liquid is measured at the second location and the relative amounts of the immobile and mobile fluids in the formation are determined. The single well technique is preferred, however, since shorter injection and production times can generally be employed by this method.

The principle of the invention and the best mode in which it is contemplated to apply that principle have been described. It is to be understood that the foregoing is illustrative only and that other means and techniques can be employed without departing from the true scope of the invention defined in the following claims.

What we claim is:

1. A method for determining the relative amounts of two existing fluid phases in a portion of a subterranean reservoir formation having a known temperature and fluid pressure, wherein one of the phases is mobile and the other is essentially immobile comprising:

injecting into said formation by means of a well a measured volume of fluid which is unsaturated with said immobile fluid and which has limited solubility for said immobile fluid, selecting the amount of said injected fluid to create a liquid front with a first fluid volume before said front and a second fluid volume between said front and said well such that at least a measurable portion of said injected fluid within said formation remains unsaturated with said fluid of said immobile phase;

producing said injected fluid by means of said well in an amount sufficient to determine the volume of injected fluid substantially unsaturated with immobile fluid by measuring the volume of said injected fluid substantially unsaturated with immobile liquid produced from the well as indicted by an appreciable increase in concentration of said immobile fluid in said mobile fluid which characterizes the location of said front, said front being characterized by a substantial increase in the amount of said immobile fluid in said injected fluid;

whereby said measured volume is taken as the unknown $V_2$ in the equation as follows:

$$S_{gr} = \frac{C_s}{C_g} \cdot \frac{V_1 - V_2}{V_2} \qquad \text{Equation 1}$$

Where $S_{gr}$ = residual gas saturation, fraction of reservoir pore volume;

$C_s$ = the concentration of gas dissolved in the injected liquid when the injected liquid is saturated with the gas at reservoir conditions (moles/liter);

$C_g$ = moles of residual gas per unit volume of residual gas at reservoir temperature and pressure (moles/liter);

$V_1$ = the total volume of liquid injected into the reservoir (liters);

$V_2$ = the volume of produced liquid which corresponds to the volume of injected liquid between the wellbore and the front where the gas concentration in the produced liquid changes from the original injected gas concentration to saturated gas concentration $C_s$ (liters).

2. The method as defined in claim 1 wherein the injected fluid is aqueous.

3. The method as defined in claim 2 wherein the aqueous fluid is brine.

4. The method as defined in claim 1 wherein the injected fluid is a hydrocarbon.

5. The method as defined in claim 1 wherein the injected fluid contains a trace chemical.

6. The method as defined in claim 1 wherein the immobile fluid phase is natural gas.

7. The method as defined in claim 1 wherein the immobile fluid phase is aqueous.

8. The method as defined in claim 7 wherein the immobile fluid is formation water.

9. The method as defined in claim 1 wherein the mobile fluid is aqueous.

10. The method as defined in claim 1 wherein the mobile fluid is a hydrocarbon.

11. The method as defined by claim 10 wherein the hydrocarbon fluid is crude oil.

12. The method as defined in claim 1 wherein the injected fluid is miscible with the mobile fluid phase.

13. The method as defined in claim 1 wherein the injected fluid is substantially soluble with the mobile fluid phase.

14. A method for determining the relative amounts of two fluid phases in a subterranean formation wherein one of the phases is mobile and the other is essentially immobile comprising:

injecting into the formation by means of a well a fluid unsaturated with the immobile fluid and having limited solubility with the immobile fluid in an amount such that a portion of the injected fluid within the formation remains unsaturated with immobile fluid;

producing the injected fluid by means of the well in an amount sufficient to produce injected fluid saturated with immobile fluid at the formation temperature and pressure; and measuring the concentration of immobile fluid dissolved in the produced fluid, the produced fluid volume, the temperature of the formation, and the fluid pressure of the formation.

15. A method for determining the relative amounts of two fluid phases in a subterranean reservoir formation wherein one of the phases is mobile and the other is essentially immobile comprising injecting into the formation by means of a well a measured volume of fluid unsaturated with the immobile fluid and having limited solubility with the immobile fluid in an amount such that a portion of the injected fluid in the formation remains unsaturated with immobile fluid;

producing the injected fluid by means of the well in an amount sufficient to produce injected fluid saturated with immobile fluid at the reservoir temperature and pressure;

measuring the concentration of immobile fluid dissolved in the produced fluid and measuring the produced fluid volume as a function of the concentration to determine the volume of injected fluid unsaturated with immobile fluid and to determine the amount of immobile fluid per unit volume of the injected fluid which is saturated with immobile fluid at reservoir conditions;

measuring the temperature and pressure of the formation to determine the amount of immobile fluid per unit volume of immobile fluid at reservoir conditions; and relating the amount of immobile fluid per unit volume of the injected fluid which is saturated with immobile fluid at reservoir conditions, the amount of immobile fluid per unit volume of immobile fluid at reservoir conditions, the volume of fluid injected into the formation and the volume of produced fluid unsaturated with immobile fluid to determine the relative amounts of the mobile and immobile fluid phases in the subterranean formation.

16. In a method of determining the relative amounts of two fluid phases in a subterranean reservoir wherein one of the phases is mobile and the other is essentially immobile wherein fluids are injected into a formation by means of a well and fluids are produced from the formation by means of the well, wherein the relation $$S_{gr} = \frac{C_s}{C_g} \cdot \frac{V_1 - V_2}{V_2}$$

is utilized for determining the relative amounts of the two fluid phases in the reservoir, wherein $S_{gr}$ = immobile fluid saturation, fraction of reservoir pore volume;

$C_s$ = the concentration of immobile fluid dissolved in the injected fluid when the injected fluid is saturated with the immobile fluid at reservoir conditions;

$C_g$ = the amount of immobile fluid per unit volume of immobile fluid at reservoir temperature and pressure;

$V_1$ = the total volume of fluid injected into the reservoir;

$V_2$ = the volume of produced fluid which corresponds to the volume of injected fluid between the wellbore and the front where the immobile fluid concentration in the produced fluid changes from the original injected immobile fluid concentration to saturated immobile fluid concentration;

the steps comprising:

injecting into the formation by means of a well a measured volume of fluid unsaturated with the immobile fluid and having limited solubility for the immobile fluid in an amount such that a portion of the injected fluid within the formation remains unsaturated with immobile fluid, said measured volume of fluid being the value of "$V_1$";

producing the injected fluid by means of the well in an amount sufficient to produce fluid containing immobile fluid;

measuring the concentration of immobile fluids dissolved in the produced fluid as a function of produced fluid volume to determine a value for "$V_2$" and to determine a value for "$C_s$"; and measuring the temperature and pressure of the reservoir to determine a value for "$C_g$".

17. A method for determining the relative amounts of two fluid phases in a subterranean formation wherein one of the phases is mobile and the other is essentially immobile comprising:

injecting into the formation by means of a well a measured volume of fluid unsaturated with the immobile fluid and having limited solubility with the immobile fluid in an amount sufficient to dissolve immobile fluid from a portion of the formation pore space;

producing the injected fluid by means of the well in an amount sufficient to determine the formation pore volume wherein the immobile fluid is substantially dissolved by the injected fluid;

measuring the concentration of immobile fluid dissolved in the produced fluid as a function of the produced fluid volume to determine the pore volume of the formation wherein the immobile fluid is dissolved by the injected fluid and to determine the concentration of immobile fluid dissolved in the injected fluid when the injected fluid is saturated with immobile fluid at reservoir conditions; and measuring the temperature and pressure of the formation to determine the amount of immobile fluid per unit volume of immobile fluid at reservoir temperature and pressure.

* * * * *